US005605038A

United States Patent [19]

Rozenwasser

[11] Patent Number: 5,605,038

[45] Date of Patent: Feb. 25, 1997

[54] DIAMOND CUT HOLLOW JEWELRY CHAIN

[75] Inventor: David Rozenwasser, Savion, Israel

[73] Assignee: Avraham Moshe Rozenwasser, Savion, Israel

[21] Appl. No.: 394,825

[22] Filed: Feb. 27, 1995

[30] Foreign Application Priority Data

Feb. 2, 1995 [IL] Israel ..... 112526

[51] Int. Cl.[6] ..... B21L 15/00

[52] U.S. Cl. ..... 59/35.1; 59/80

[58] Field of Search ..... 59/3, 35.1, 80, 59/82

[56] References Cited

U.S. PATENT DOCUMENTS

| | | | |
|---|---|---|---|
| 5,125,225 | 6/1992 | Strobel | 59/80 |
| 5,412,935 | 5/1995 | Rozzenwasser | 59/3 |
| 5,471,830 | 12/1995 | Gonzales | 59/3 |

*Primary Examiner*—David Jones
*Attorney, Agent, or Firm*—Helfgott & Karas, PC.

[57] ABSTRACT

A method of imparting flat diamond cut facets on hollow coiled chain links intertwined to form a jewelry chain, each coiled link having X+Y turns, where X is an integer, preferably from 1–5, and Y is one or a fraction, preferably about ¾, and where the coiled links have the coil axes oriented diagonal to the length of the chain, includes tightly winding the jewelry chain about a drum of an ice lathe with the coiled links diagonal to the drum surface, each coiled link having at least part of a turn close to the drum surface and at least part of a turn distant from the drum surface, freezing the drum and rotating it along with the jewelry chain, and spraying water on the rotating chain in a controlled manner, to freeze all turns of the hollow coiled links in ice, with the exception of at least part of the coil turns distant from the drum surface. Then a force of a pressure roller is applied to at least part of the coil turns distant from the drum surface to flatten the outer wall of the distant coil turns. The flattened area is then diamond cut without penetrating the outer wall of the coil turn, the ice is melted, and the chain is removed from the drum.

8 Claims, 5 Drawing Sheets

DIAMOND CUT HOLLOW JEWELRY CHAIN

FIELD OF THE INVENTION

The present invention relates to jewelry chains, particularly hollow chains, having high luster diamond cut facets. The invention particularly relates to chains made with hollow spiral links.

BACKGROUND OF THE INVENTION

Jewelry chains in general are well known, as are chains with diamond cut facets. Chains having round solid links present no major problem in cutting the facets, since the link wall is partly cut away and the depth of the cut can vary, allowing a certain tolerance as to the amount of metal that is removed. The surface area created by the cutting away of part of the chain link provides the facet, which surface area is dependent on the amount of metal cut away. Thus there are known solid jewelry chains of all types with diamond cut facets as, for example, diamond cut rope chains, diamond cut Garibaldi chains etc. One way of diamond cutting solid chains is by using a so-called ice lathe. This method is well known and was already disclosed in U.S. Pat. No. 3,083,002 to Lacey and U.S. Pat. No. 4,754,535 to Valtiero, among others. This method is as follows. A jewelry chain is wound tightly around a hollow drum held between the centers of a universal lathe. The ends of the chain are secured to a fastner on each end of the drum. The drum is rotated and a freezing medium, such as glycol, is circulated from a refrigerating unit to the inside of the drum. As the temperature of the drum drops with the chain wound round it, cold water is sprayed on to the drum's surface and is almost instantaneously frozen as it contacts the surface of the drum. The frozen water thus surrounds the chain in contact with the drum, freezing the chain links in place and immobilising the chain. In fact, only a small portion of each chain link has to be frozen in order to immobilise the whole chain, since the entire chain is held firmly and immobilised, if at least part of each link is embedded in ice.

Once the chain is immobilised, a diamond cutting tool can be applied to the chain as it rotates on the drum, cutting off the outermost sections of the links, thus producing diamond cut facets. The deeper the cut, the larger the facet. This is all good and well for solid chains. However, this is not applicable to diamond cutting facets on chains made with hollow annular links. Such hollow links generally have a very thin outer metal shell in the range of 0.05 mm to about 0.2 mm. Annular or curved hollow links with such thin walls present a serious problem if one wishes to impart to the link a diamond cut facet, since cutting into the curved section of the link will produce a hole rather than a flat surface.

My U.S. Pat. No. 5,303,540 proposes one solution for preparing diamond cut hollow chains and chain links by providing the link with diamond cut surface areas in the shape of the outer contour of the link, i.e. where only the outer wall of the hollow chain link is shaved without deforming the wall or cutting into it. Diamond cut facets on curved sections of the links will, therefore, not be flat, but rather curved in accordance with the curvature of the link at the place of the facet.

U.S. Pat. No. 5,125,225 to Strobel discloses a method for making diamond cut flat facets on hollow rope chains, including chains having seamed hollow links, having the same appearance as in the classical diamond cut rope chain. This is accomplished by first flattening the curvature on the round links and then diamond cutting the flattened surface.

In order to achieve the flattening of the links, the patent uses the ice lathe method to immobilise the rope chain by winding the chain around a refrigerated drum and freezing the chain in place. The frozen chain is then incrementally burnished as it is rotated to impart to the individual links flattened surfaces. These surfaces are then diamond cut while the chain is still immobilised to give sparkling flat facets. Strobel thus applies the known ice lathe technique to hollow rope chains having annular links to immobilize the hollow chain by embedding it in an ice mould. The Strobel patent is directed to hollow rope chains with annular links.

In both cases, whether diamond cutting solid or hollow rope chains with annular links, it is sufficient to freeze only a small part of each annular link in order to immobilise the whole chain and prevent it from moving. In the case of hollow rope chains, only the lower half of the chain is embedded in ice near the drum surface, since if one were to cover the entire chain with ice it would be difficult to form a flat indentation in the annular link, because solid ice formed inside the hollow link would resist the deformation of the link wall. In any event, immobilising chains with annular links is quite simple and does not require a high level of exactness when freezing the chain. Consequently since immobilising a rope chain and all its annular links is relatively simple, it makes it possible to burnish the hollow annular link chains precisely to a predetermined depth to form flat facets which can then be diamond cut, while the chain is still immobilised, without cutting into the thin link wall.

There are a number of chains, however, not rope chains, that are made with spiral links, in which each link is in the form of a coil with more than one turn. Such links can comprise X+Y turns, where X is an integer, preferably from 1–5 and Y is an integer or a fraction. Chains with coiled links intertwined with one another have the coiled links oriented in such a way that their central axis is diagonal to the axis of the chain length. One popular chain of this kind, called a Garibaldi chain, comprises sections of chains made with coiled links having one and three quarter turns. Coiled chains, such as the Garibaldi chain, are also known to have diamond cuts, but this is only where the chain is made of solid coils. The coiled links inherently have a certain degree of springiness and thus can oscillate when touched. In the case of chains with solid coiled links, this oscillation does not prevent diamond cutting flat facets, since such facets are cut to substantial depths into the solid link wire, so that even if the coil link oscillates somewhat, for example 0.01 mm, in a coil having a wire diameter of 0.5 mm it does not siginificantly affect the facet, which is cut substantially deeper into the wire than the 0.01 mm. In other words, cutting facets in coiled link chains is possible when the links are solid. This is not the case with hollow coiled link chains. When attempting to make diamond cuts in hollow coiled link chains, conventional freezing of the chain by the ice lathe method leaves portions of coils unfrozen, resulting in slight oscillation of the coils, which is detrimental to flattening and diamond cutting the thin coil walls. Attempting to make flat diamond cut facets by conventional freezing of hollow coil link chains results in at least some of the flat surfaces of the coil links having their walls perforated due to the angular orientation of the coils with respect to the chain length and their oscillation. Freezing the chain on the drum in the conventional manner does not prevent the oscillation of the coil. If one were, on the other hand, to embed the entire chain in ice, this would prevent uniform flattening and diamond cutting because of the ice formed inside the hollow part of the coiled link and also on the top surface of the coiled link.

SUMMARY OF THE INVENTION

It is an object of the present invention to provide hollow diamond cut chains comprising coiled links.

It is another object of the present invention to provide jewlery chains comprising coiled links with flat diamond cut surfaces on the coiled links.

Yet another object of the invention is provide a method for imparting flat diamond cut facets on hollow coiled links of a jewelry chain.

In keeping with these objects and with others, which will become apparent hereinafter, the present invention comprises a method of imparting flat diamond cut facets on hollow coiled chain links intertwined to form a jewelry chain, each coiled link having X+Y turns, where X is an integer, preferably from 1–5, and Y is one or a fraction, preferably about ¾, said coiled links having the coil axes oriented diagonal to the length of the chain, comprising:

tightly winding said jewelry chain about a drum of an ice lathe with the coiled links diagonal to the drum surface, each coiled link having at least part of a turn close to said drum surface and at least part of a turn distant from said drum surface;

freezing said drum and rotating it with said jewelry chain;

spraying water on said rotating chain in a controlled manner, to freeze all turns of the hollow coiled links in ice, with the exception of the at least part of the coil turns distant from said drum surface;

applying force to the said at least part of the coil turn distant from said drum surface, thereby flattening at least a portion of the outer wall of said distant coil turn;

diamond cutting said flattened area without penetrating the outer wall of said coil turn;

melting the ice; and removing the chain from the drum.

In a preferred method, a force is applied to the coil turn by pressure rollers, although incremental flattening can be accomplished with a burnishing tool in a manner similar to that of the above mentioned Strobel patent. It should be appreciated that there is a delicate balance between the frozen section of the chain, which is enclosed in ice, and the section on the hollow coil, which is to be flattened, that must be free of ice. Thus, it is essential that all the turns in the coil be frozen in order to immobilise each of them to prevent oscillation, and yet leave the section of turn to be flattened ice-free, so that pressure exerted on its outer walls can form an indentation and create a flattened surface.

This delicate balance of freezing all the turns of the coils and only up to a given point, can be achieved by controlled freezing. In accordance with one embodiment of the invention, this control is accomplished by spraying the water on the rotating drum at a speed at which the water spray is not cast off the drum by centrifugal forces, nor allowed to drip from the bottom of the drum. This is done by controlling the amount of water that is sprayed, the dispersion and particle size of the water spray and the speed of rotation of the frozen drum. In the process of freezing and immobilising the chain on the drum, the water has a tendency to enter the slit of the hollow links and form ice within the hollow part of the link. This is quite acceptable with respect to those parts of the coiled link which are not to be deformed or faceted. However, the link sections which are to be indented or flattened must remain free of ice. Once the chain is immobilised and the coil links cannot oscillate, the flattened facets can be made by indenting the outer link wall, which can then be diamond cut with high precision to a depth of between 0.005 mm to 0.2 mm, depending on the thickness of the hollow coil wall. In a preferred alternative embodiment, the chain is first fully embedded in ice with some of the ice even covering the chain. The excess ice is shaved off the chain if need be, leaving a very thin layer of ice, about 0.1–0.5 mm, over the chain. The upper layer of ice surrounding the outermost protions of the chain is then slowly and controllably melted away, such as with a heating mantle, until the section of coil to be flattened is freed of any inner and/or outer ice. The chain is thus fully immobilised yet free of ice when the flattening is to take place. By this method, the flattening of facets can be well controlled so that diamond cutting the facets can be precise without making any holes in the hollow walls of the links.

BRIEF DESCRIPTION OF THE DRAWINGS

The present invention will be more fully understood and appreciated from the following detailed description taken in conjunction with the drawings, in which.

DETAILED DESCRIPTION OF THE INVENTION

Figure 1:
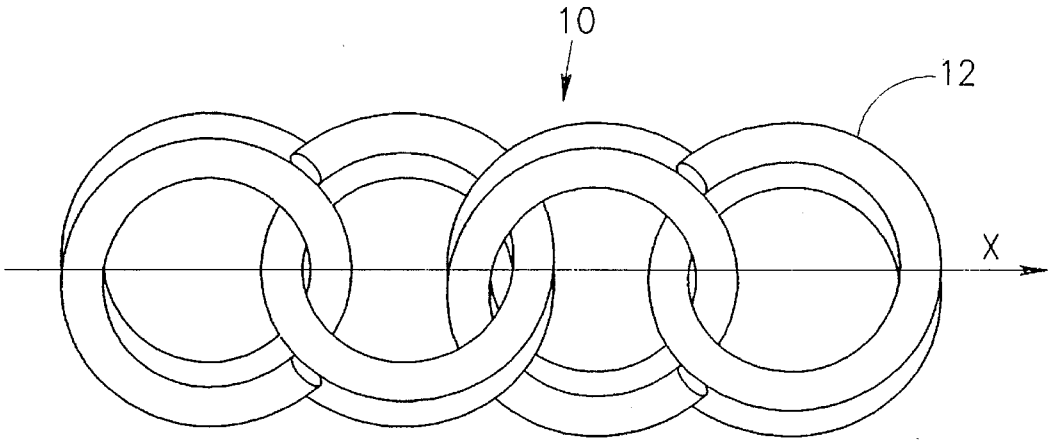
FIG. 1 is a plan view of a chain comprised of intertwined coiled links having one and three quarter turns.

Referring now to FIG. 1, there is shown a section of chain 10 comprised of coiled links 12 intertwined with one another. The intertwining results in the adjacent coils being at an angle to one another and each coil is at an angle to the direction of the chain X.

Figure 2:
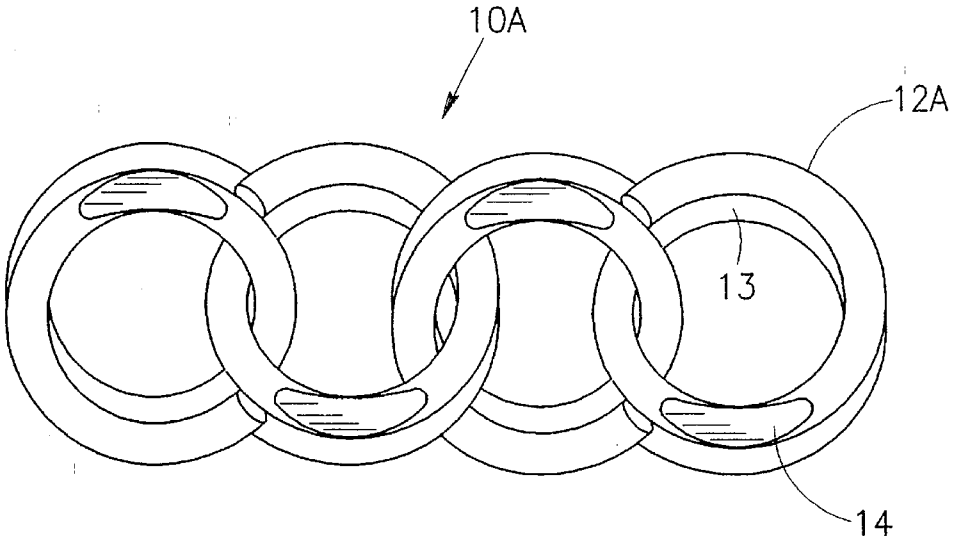
FIG. 2 illustrates the chain of FIG. 1 having diamond cut facets on the outer turn of the coiled links.

Referring now to FIG. 2, there is illustrated a chain 10A, whose links 12A have diamond cut facets 14 on the outermost turn of the link 12A. Similar diamond cut facets exist on the other side of the chain on the coil turns (not visible in this Figure).

Figure 3A:
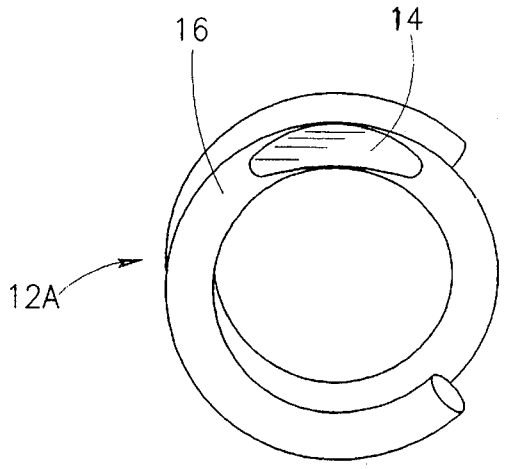
FIG. 3A is a plan view of a faceted coiled link of one and three quarter turns.
Figure 3B:
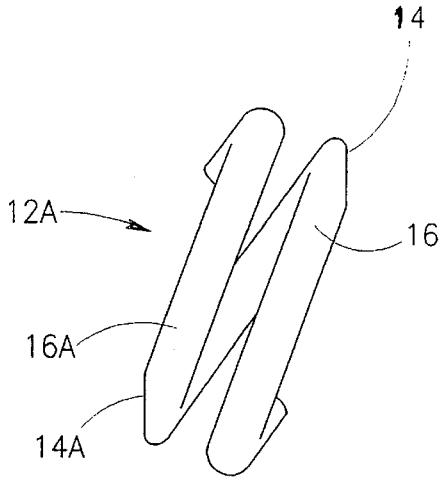
FIG. 3B is a side view of the faceted coiled link of FIG. 3A.

FIGS. 3A and 3B illustrate an individual faceted coiled link 12A. The link has about one and three quarter turns, with facets 14 and 14A on the turns 16 and 16A respectively of link 12A. The facets 14 and 14A on coil turns 16 and 16A are on the outermost level of the links when the chain is lying flat on a surface. In practise, the chain is first faceted and diamond cut on one side, providing facet 14. It is then removed from the ice drum, turned over and the process is repeated on the other side. Each coiled link thus receives two facets 14 and 14A as illustrated in FIG. 3B.

Figure 4A:
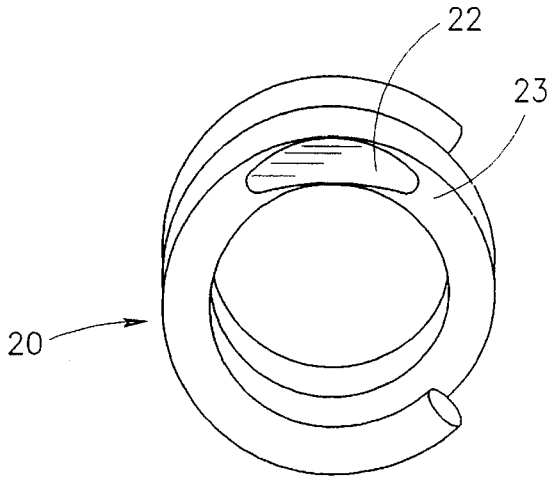
FIG. 4A is a faceted coiled link having two and three quarter turns.
Figure 4B:
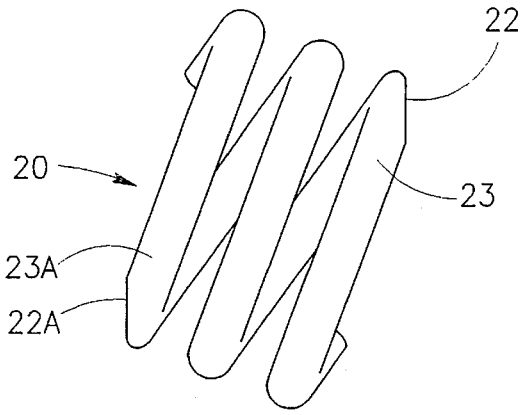
FIG. 4B is a side view of the faceted coiled link of FIG. 4A.

In accordance with the invention, the number of turns in the coiled links may vary, as is illustrated in FIGS. 4A and 4B, where the coiled link 20 has two and three quarter turns, with facets 22 and 22A on the end turns 23 and 23A respectively.

Figure 5:
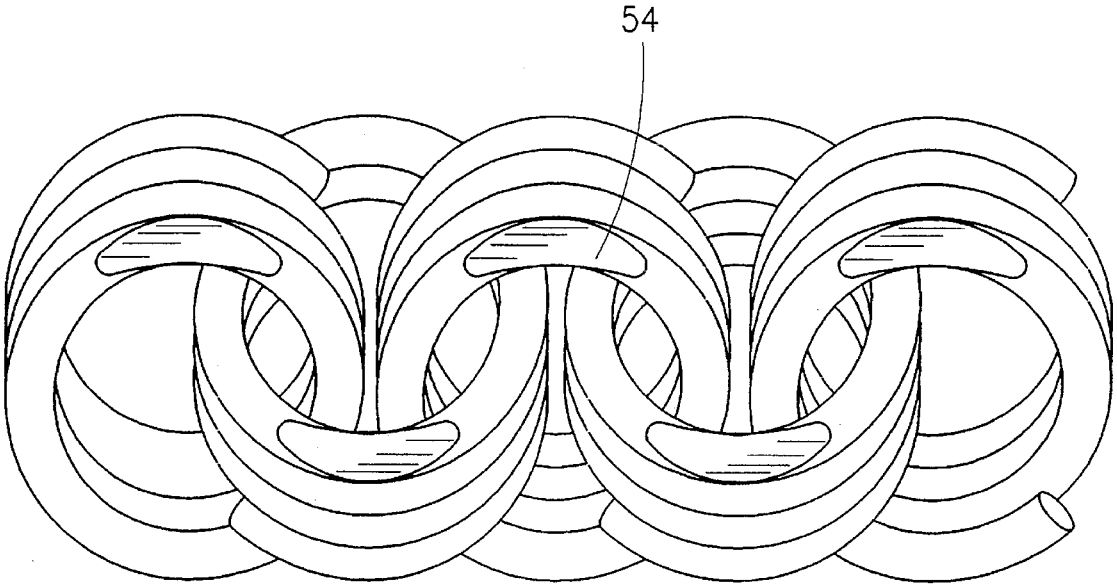
FIG. 5 is a plan view of a chain with intertwined diamond cut faceted coiled links having three and three quarter turns.

A faceted chain made with intertwined coiled links having three and three quarter turns is illustrated in FIG. 5.

Figure 6:
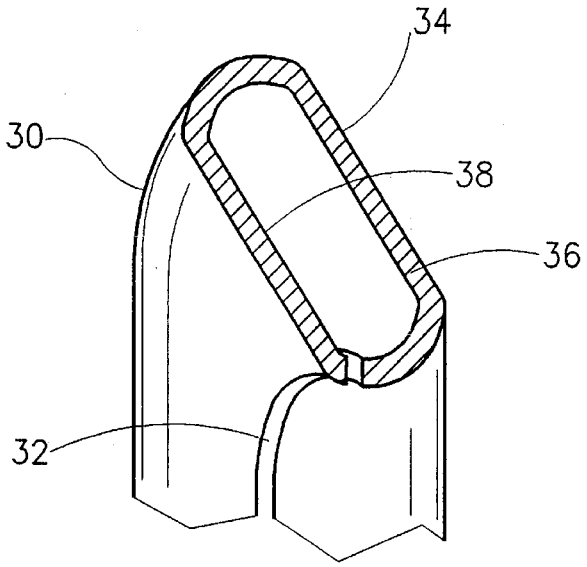
FIG. 6 is a close up partial sectional perspective view of a diamond cut faceted hollow coiled link.

Turning now to FIG. 6, there is shown the tubular cross-section of a faceted area of a hollow coiled link 30. The link 30 has a center inner seam 32 which is on the inside of coil 30. A facet 34 is created on the outer wall 36 of the coil by pushing in the wall 36 and indenting the originally round curvature of the hollow link 30, so that the outer wall 36 approaches the inner wall 38. The facet 34 is on the side of the link 30 and not directly opposite the seam, which is the case with faceted hollow rope chains.

Figure 7:
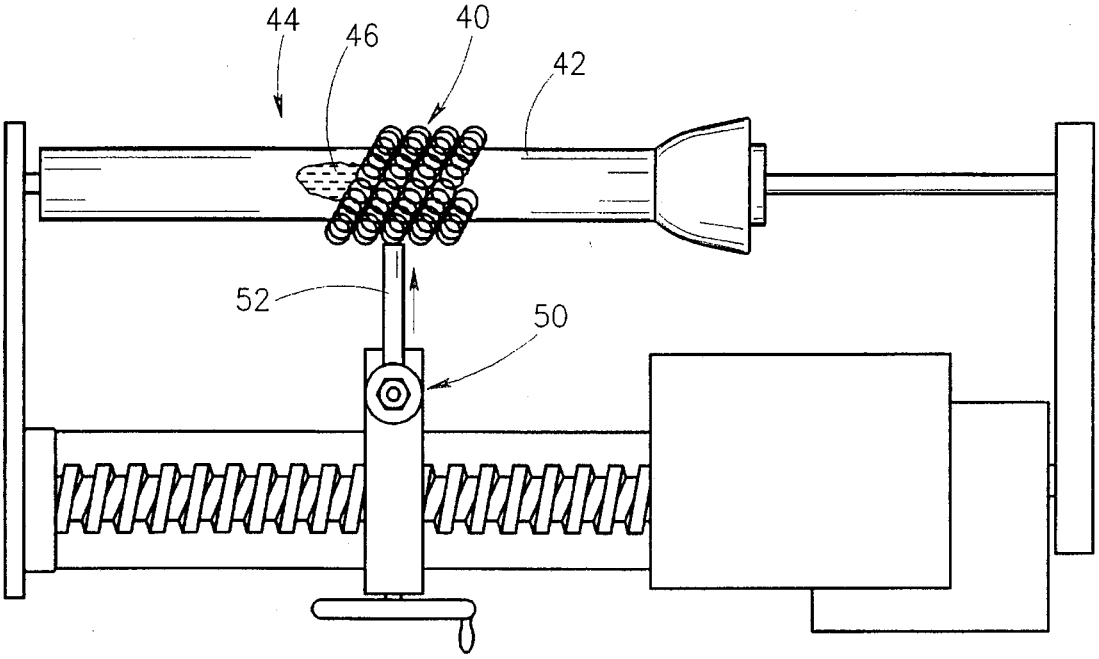
FIG. 7 is a schematic plan view of an ice lathe with a portion of chain wound around a rotating drum and a burnishing head for indenting a facet onto the outer wall of the chain links.
Figure 8:
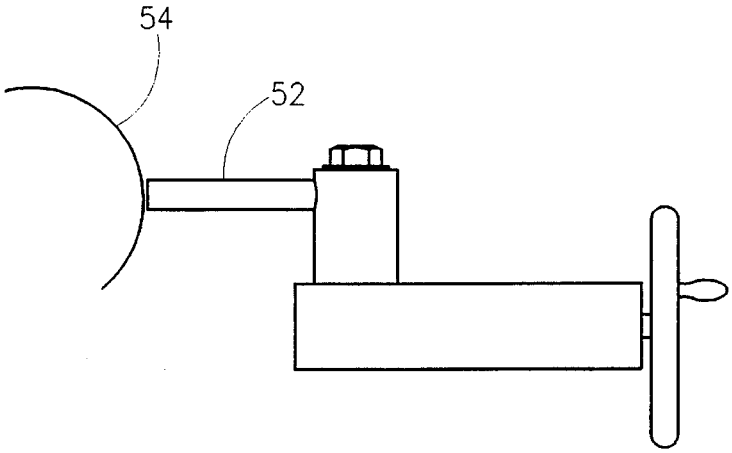
FIG. 8 is a close up view of the burnishing head shown in FIG. 7, pressing against a hollow link.

The flat facets on the coiled links are prepared as follows, with reference to FIGS. 7 and 8. A chain 40 containing coiled links is wound about a drum 42 of an ice lathe 44. A freezing fluid 46, such as glycol, is circulated inside the drum 44. The drum 44 is then rotated and water is sprayed on the chain. The amount of water, the spray and the rate at which the drum is turned is adjusted so that all the water freezes on the surface 42 of the drum 44 about the chain 40 and is not thrown off by centrifugal force (high speed), nor allowed to drip off the drum (slow speed). This carefully controlled method of freezing allows formation of ice in consecutive layers, starting on the drum surface and surrounding each of the turns of the coiled links as the ice builds up. The freezing process is stopped prior to the ice forming on the outermost turn of the hollow coiled link.

As the frozen chain 40 rotates, a burnishing tool 50 follows the course of the chain, with the hammerhead 52 applying force to the outermost 54 turns (FIG. 8) of the coil links on the chain 40. At the end of the faceting process, a diamond cutting edge (not shown) is passed over the chain to shave off a very thin layer of precious metal from the flat facet, in the order of 0.005 mm to 0.2 mm, depending on the thickness of the hollow link wall. This can be accomplished successfully without making perforations or holes in the hollow coiled links, because each and every turn of the link is immobilised by the ice, allowing precision flattening of the link section. At the end of this diamond cutting procedure, hot water is poured over the chain to melt the ice and the chain 40 is removed from the drum 42. The chain is then wound around the drum on its other side and the procedure is repeated, forming diamond cut facets on the other sides of the chain, resulting in each coiled link having two facets 14 and 14B, as illustrated in FIG. 3B, and 22 and 22A, as illustrated in FIG. 4B.

Figure 9:
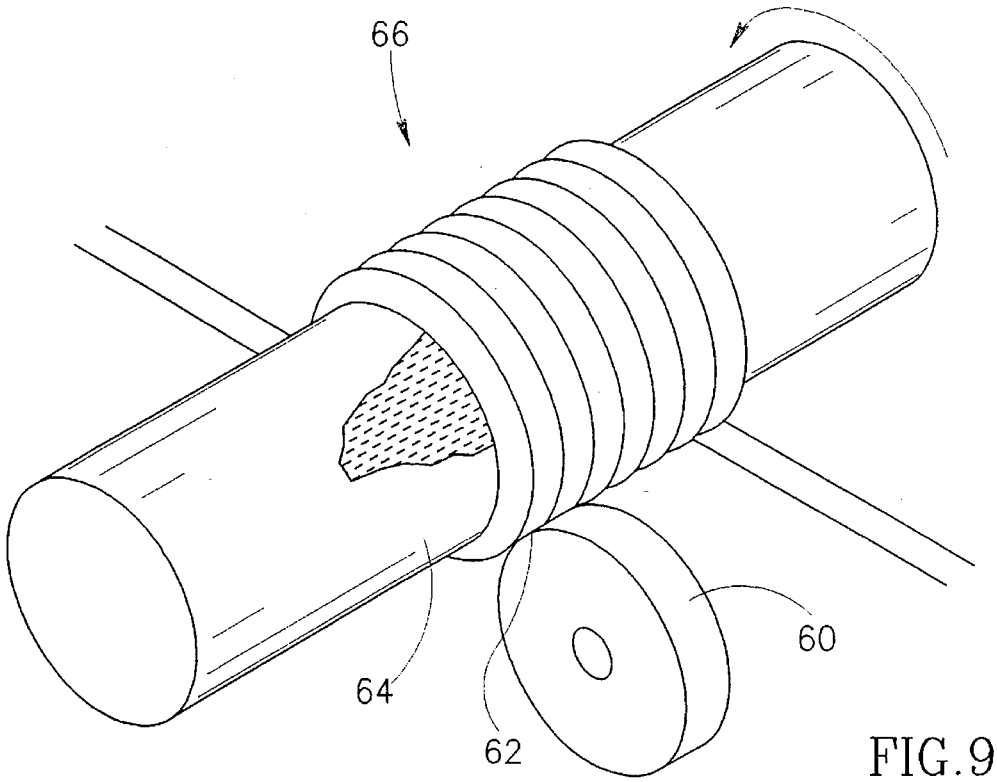
FIG. 9 schematically illustrates a method of the invention using a pressure roller for applying force to the outer wall of the links to create facets.

An alternative way of providing flat facets on to a coil link chain is illustrated in FIG. 9 by using a pressure roller 60 to press against chain 62, wound around the drum 64 of an ice lathe 66. Since the outer turns of the coil links will be protruding furthest from the drum surface, the pressure roller 60 will uniformly flatten the outer wall thereof. The degree of flattening can, of course, be controlled by the distance set between the roller and the chain.

Figure 10:
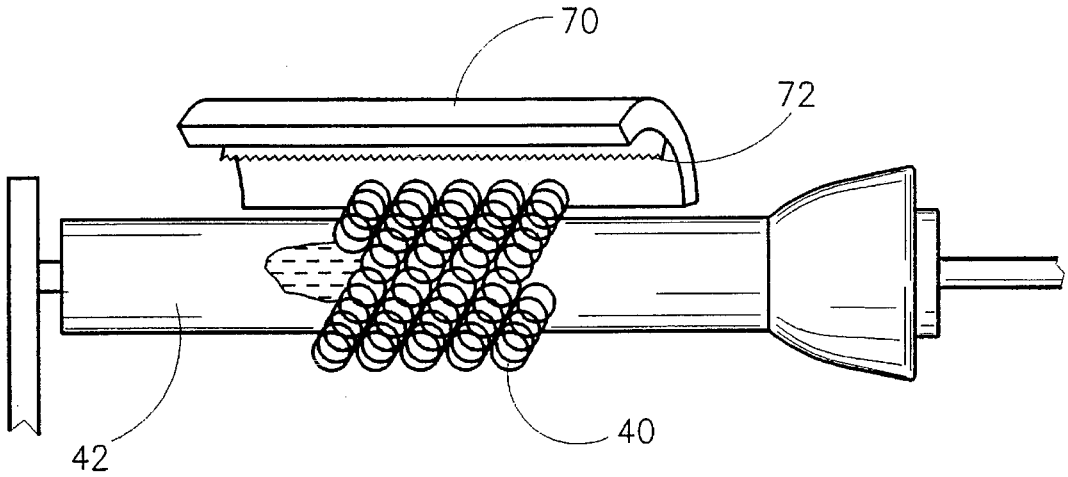
FIG. 10 schematically shows another preferred embodiment of the invention, wherein a fully ice embedded chain is thawed selectively to remove an outer ice layer.

In an alternative preferred embodiment, there is shown in FIG. 10 a chain 40 containing coiled links wound around a freezing drum 42 of an ice lathe. Water is sprayed onto the chain 40 as it rotates on the drum 42 until an ice coat covers the entire chain plus a little more. The chain is thus completely immersed in ice and immobilised. With a sharp knife edge (not shown) the excess ice is scraped off the chain 40 leaving just a very thin ice coating on the chain 40. A heating mantle 70 is placed over the chain 40 and the ice around the chain 40 most distant from the drum surface 42 is melted slowly and controllably with electric coil 72 as the chain rotates, until the outermost turns of the coiled links are thawed. The hollow coil links are thus still immobilised although the portion of the coil that is to be flattened and diamond cut is free of ice. The heating mantle is removed and the flattening and diamond cutting can then proceed as described above.

It will be appreciated by those skilled in the art that the invention is not limited to what has been shown and described hereinabove by way of example. Rather, the scope of the invention is defined solely by the claims which follow.

I claim:

1. A method of imparting flat facets on hollow coiled chain links intertwined to form a jewelry chain, each coiled link having X+Y turns, where X is an integer, preferably from 1–5, and Y is one or a fraction, preferably about ¾, said coiled links having the coil axes oriented diagonal to the length of the chain, the method comprising:

tightly winding said jewelry chain about a drum of an ice lathe with the coiled links diagonal to the drum surface, each coiled link having at least part of each turn of said coil close to said drum surface and at least part of each turn of said coil distant from said drum surface;

freezing said drum and rotating said drum with said jewelry chain;

spraying water on said rotating chain in a controlled manner, to freeze at least part of each of the turns of said coiled links in ice, leaving at least a part of each of the turns of said coils distant from said drum surface free of ice;

applying a force of a pressure roller against at least one of said at least part of each of the turns distant from said drum surface left free of ice so as to at least partially flatten the outer wall of each of said distant turns left free of ice;

melting the ice; and removing the chain from the drum.

2. A method according to claim 1 wherein the coil links have between one and two turns.

3. A method according to claim 1 wherein the coil links have between two and three turns.

4. A method according to claim 1 wherein the coil links have between three and four turns.

5. A method according to claim 1 wherein Y is an integer.

6. A method according to claim 1 wherein the water is sprayed on the drum at a speed at which the water spray is not cast off the drum by centrifugal force nor allowed to drip from the bottom of the rotating drum.

7. A method according to claim 1 wherein the spraying of water on said rotating drum comprises spraying sufficient water to embed the complete chain in ice, and wherein the freezing of all turns of the hollow coiled links in ice, except the at least part of the coil turns distant from said drum surface, is accomplished by controlled thawing of the outer surface of the chain until sufficient ice has melted to expose the outermost coiled links, leaving them free of ice sufficiently to enable forming facets on said links.

8. A method according to claim 1, wherein the flat facet is diamond cut prior to melting the ice.

* * * * *